US007044672B2

(12) United States Patent
Yu

(10) Patent No.: US 7,044,672 B2
(45) Date of Patent: May 16, 2006

(54) MULTIPLE COLOR LED AND INK PEN LIGHT

(76) Inventor: Sun Yu, 2850 Coolidge Hwy., Berkley, MI (US) 48072

( * ) Notice: Subject to any disclaimer, the term of this patent is extended or adjusted under 35 U.S.C. 154(b) by 0 days.

(21) Appl. No.: 10/366,185

(22) Filed: Feb. 13, 2003

(65) Prior Publication Data

US 2004/0161287 A1 Aug. 19, 2004

(51) Int. Cl.
*B43K 29/00* (2006.01)

(52) U.S. Cl. ..... 401/195; 362/118

(58) Field of Classification Search ..... 401/195, 401/52, 192; 362/118, 184, 109, 800
See application file for complete search history.

(56) References Cited

U.S. PATENT DOCUMENTS

| | | | | |
|---|---|---|---|---|
| 2,663,791 A | | 12/1953 | Hettrick | 240/6.46 |
| 2,811,632 A | | 10/1957 | Bartlett | 240/6.46 |
| 3,303,337 A | | 2/1967 | Lo | 240/6.46 |
| 4,076,427 A | * | 2/1978 | Anderson | 401/6 |
| 4,890,204 A | | 12/1989 | Lin et al. | 362/118 |
| 5,131,775 A | | 7/1992 | Chen | 401/195 |
| 5,673,996 A | * | 10/1997 | Ducker | 362/118 |
| 6,164,856 A | * | 12/2000 | Lo | 401/195 X |
| 6,231,204 B1 | | 5/2001 | Lo | 362/118 |
| D451,138 S | | 11/2001 | Rosenbaum | D19/36 |
| 6,311,839 B1 | | 11/2001 | Lo | 206/371 |
| 6,390,641 B1 | * | 5/2002 | Liu | 362/118 |

FOREIGN PATENT DOCUMENTS

| | | | | |
|---|---|---|---|---|
| GB | 2212449 A | * | 7/1989 | 401/195 |

* cited by examiner

*Primary Examiner*—David J. Walczak
(74) *Attorney, Agent, or Firm*—Gifford, Krass, Groh, Sprinkle, Anderson & Citkowski, P.C.

(57) ABSTRACT

A multi-colored self-illuminating writing implement whereby one of a plurality of light sources contained within the housing of the writing implement is made selectable by the user as desired. The self-illuminating writing implement includes a marker mounted within the housing adjacent a marking end of the writing implement. A battery is also disposed within the housing for providing power to the selected light source. A plurality of light sources are mounted to a de-multiplexing switch that allows the user to selectively place one of the plurality of light sources in electrical communication with the battery mounted within the housing.

8 Claims, 4 Drawing Sheets

Fig-5
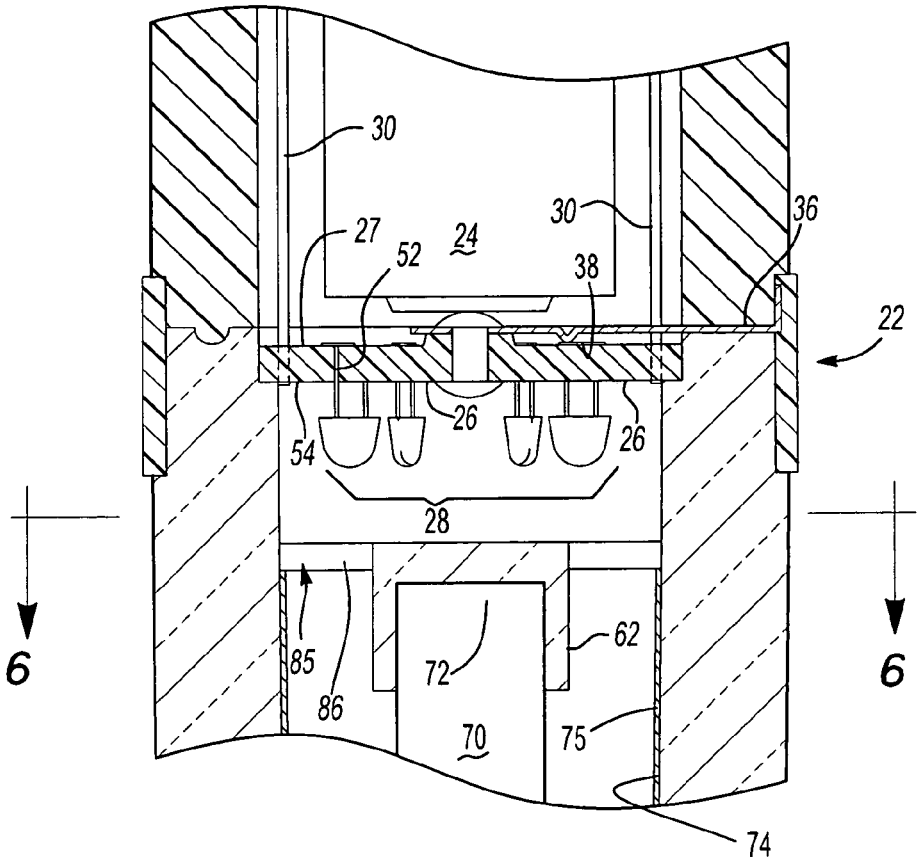
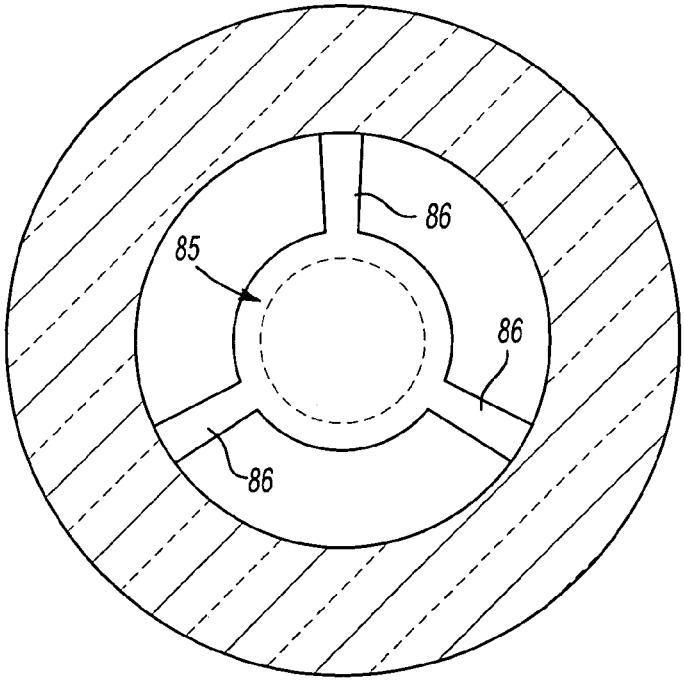
Fig-6

MULTIPLE COLOR LED AND INK PEN LIGHT

FIELD OF THE INVENTION

The present invention relates to a writing implement which includes features for illuminating a writing surface; more particularly, a writing implement that allows a user to select one of a plurality of different colored light sources to provide the illumination.

BACKGROUND OF THE INVENTION

The novelty of providing a writing implement capable of illuminating a writing surface in the dark is not new and has been addressed in a large number of self-illuminating writing devices.

Conventionally, self-illuminating writing implements are comprised of a first housing portion that includes a source of illumination such as a single LED or incandescent lamp in communication with a battery or power cell. A second portion of the housing most commonly includes a translucent portion, in addition to a marker, whereby illumination from the light source can be emitted onto a writing surface.

To enhance the utility of self-illuminating writing implements, artisans employ the use of special lenses to refract the light being emitted from the light source such that the light is substantially focused toward the tip of the writing implement causing greater illumination on the writing surface.

In some cases, the user may find that they prefer a particular color of illumination while writing in darkened conditions as opposed to another. A certain color of illumination may be more appealing to a user or may improve the user's ability to see the writing surface over and above other colors of illumination.

The present invention provides a self-illuminating writing implement that allows a user to select one of a plurality of different colored light sources to provide illumination to the writing surface.

SUMMARY OF THE INVENTION

The present invention has utility as a self-illuminating writing implement for illuminating a writing surface at nighttime, under darkened conditions, or at other times as desired by the user simply as an amusement to themselves or others.

The self-illuminating writing implement includes a housing that has a translucent portion adjacent its marking end. The housing may include a reflective coating disposed on its interior wall to enhance the propagation of light being emitted from a light source contained therein to the translucent portion adjacent the marking end.

A marking element is mounted within the housing adjacent its marking end such that the tip of the marker extends beyond the marking end of the housing to allow for marking on a marking surface.

At least one battery is mounted within the housing and provides a source of power for the self-illuminating writing implement.

A plurality of light sources are also mounted within the housing. Each of the light sources is arranged in the housing such that light may be emitted through the translucent portion of the marking end of the housing when any light source is placed in electrical communication with the battery.

A de-multiplexing switch is provided for the user to select at least one light source for illumination. The de-multiplexing switch is in direct communication with the battery and includes an adjustable conducting element whereby the user selectively places at least one light source in electrical communication with the battery to cause the light source to illuminate. Preferably, each light source contained within the housing illuminates a different color light such that the user may select any one of the particular colors as desired.

The de-multiplexing switch may further include a switch position that leaves the battery circuit open such that the self-illuminating writing implement does not emit light and the battery potential is preserved. Simply stated, this position on the de-multiplexing switch simply turns the illuminating means off while still permitting the user to use it is a marker.

The self-illuminating writing implement of the present invention allows the user to select at least one of a plurality of light sources to be placed in electrical communication with the battery such that illumination is provided on a marking surface. As such, the user is allowed to select a color of illumination that enhances his or her ability to see what is being written on the marking surface or simply to choose a particular color of illumination as desired.

BRIEF DESCRIPTION OF THE DRAWINGS

The present invention will be better understood by reference to the followed detailed description in conjunction with the accompanying drawings in which like reference characters refer to like parts throughout the several views and in which:

FIG. 5 is a detailed view of the plurality of light sources and elements of the selector ring assembly as according to the invention;

FIG. 6 is a transverse cross section along line 6 of FIG. 5 of the marking portion of the self-illuminating writing implement;

DETAILED DESCRIPTION OF THE PREFERRED EMBODIMENT

The self-illuminating writing implement of the present invention has utility as a device for marking on a marking surface in darkened conditions. An additional benefit is provided in that the source of illumination is made selectable by the user such that he or she may choose one of a plurality of different colors for illuminating the writing surface. It is appreciated that a user's sensitivity to a particular color of illumination may be greater than his or her sensitivity to other colors of illumination. Thus, by providing the user a means of selecting a particular color of illumination, it may enhance the user's ability to view the marking surface.

Figure 1:
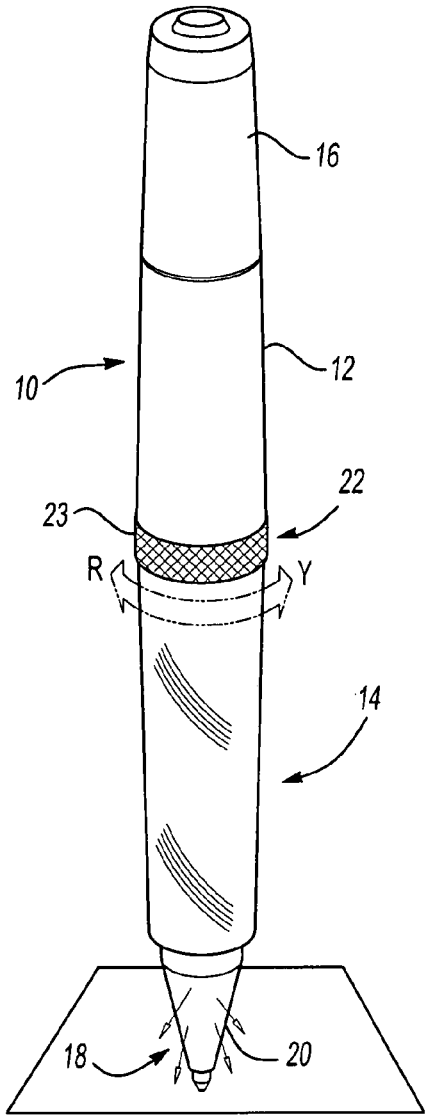
FIG. 1 is a perspective view of the self-illuminating writing implement as according to the invention.

FIG. 1 illustrates a perspective view of the self-illuminating writing implement generally indicated at 10 that includes a housing being comprised of an illuminating portion 12 and a marking portion generally indicated at 14.

The illuminating portion 12 includes a top end 16 removably fastened thereto. Removal of the top end 16 of the housing exposes an interior cavity within the illuminating portion 12 that is dimensioned to receive at least one battery 24 for use as a power source for the self-illuminating writing implement 10.

The marking portion 14 includes a marking end 18 having a translucent portion 20 adjacent thereto. The translucent portion 20 is operative to allow illumination to be emitted from within the interior of the self-illuminating writing implement 10 onto a writing surface.

A rotatable selector ring assembly generally indicated at 22 is provided for the purpose of allowing a user to rotatably select a particular source of illumination supported within the self-illuminating writing implement 10. The selector ring assembly 22 operates as a de-multiplexing switch wherein electrical energy from the power source stored within the housing is selectively placed in electrical communication with a single source of illumination supported within the housing. As shown in FIG. 1, the selector ring assembly 22 may rotate in a first direction to select a yellow Y source of illumination and a second direction to select a red R source of illumination. It may become apparent to those skilled in the art that other types of switches may be used in place of the selector ring assembly 22 without exceeding the scope of the invention.

In the preferred embodiment the housing is made of a nonconductive material such as plastic, fiberglass or the like. However, it is appreciated that portions of the housing or the whole may be made from other materials including conductive materials.

Figure 2:
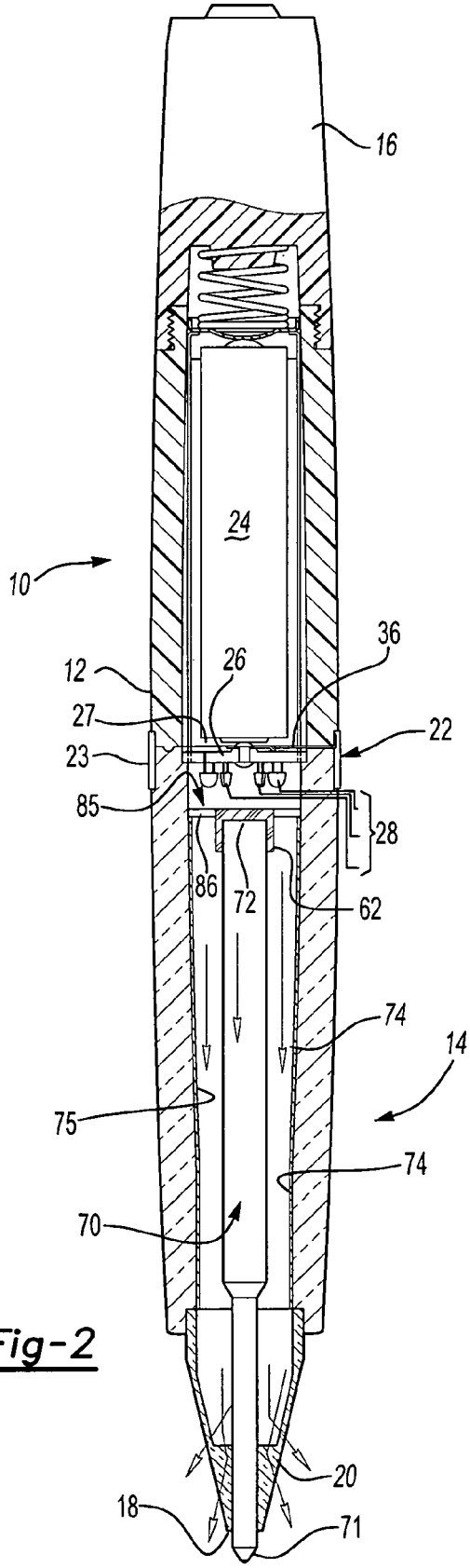
FIG. 2 is an elongated cross section of a preferred embodiment of the self-illuminating writing implement as according to the invention.

Referring now to FIG. 2, a longitudinal cross section of the self-illuminating writing implement 10 is presented. The illuminating portion 12 is shown having a battery 24 disposed therein. As explained above, the top end 16 of the illuminating portion is removably attached via a conventional fastening means which may include complementary threaded members, snap fasteners or complementary retaining arms and edges that, once removed, a battery 24 may be placed within the body of the illuminating portion 12. Although a single battery 24 is illustrated as the power source for a self-illuminating writing implement 10, it is appreciated that a plurality of batteries or other power sources may be used without exceeding the scope of the invention.

Once disposed within the interior cavity of the illuminating portion 12, at least one pole of the battery 24 is in electrical communication with the selector ring assembly 22.

Figure 7:
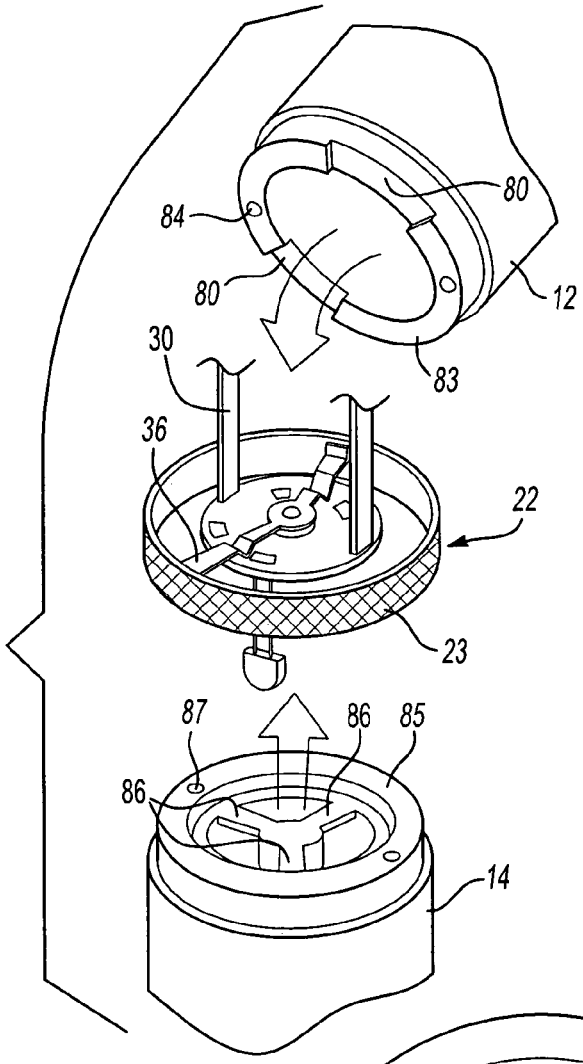
FIG. 7 illustrates an exploded view of the complementary fastening rims of the illuminating and marking portions of the self-illuminating writing implement and their assembly relative to the selector ring assembly.
Figure 8:
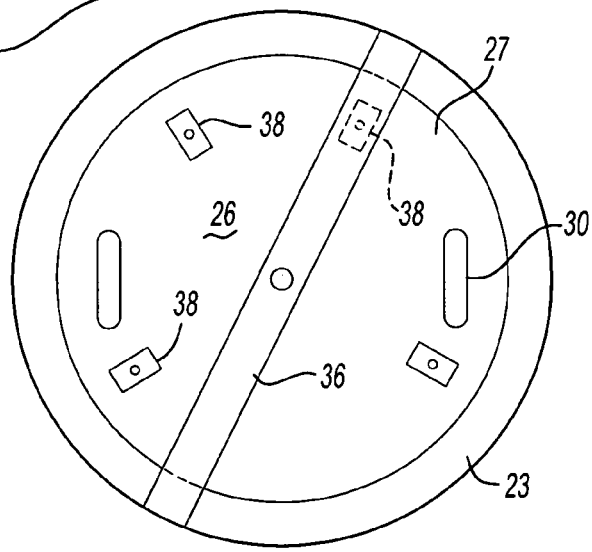
FIG. 8 is a top view of the plate that supports the plurality of light sources as part of the selector ring assembly.

As best illustrated in FIG. 7, the selector ring assembly 22 includes an actuating portion 23 having a conductive member 36 attached thereto. As illustrated, the actuating portion 23 is ring shaped and the conductive member 36 is diametrically attached thereto.

The actuating portion 23 is concentrically attached to a plate 26 that includes a plurality of light sources 28 mounted thereto. A top surface 27 of the plate 26 is substantially nonconductive but comprises a plurality of isolated conductive pads 38 positioned at functional locations adjacent the outer edge of the plate 26. The conductive pads 38 are arranged such that a single pad may be selectively placed in electrical communication with the conductive member 36 of the actuating ring 23 as desired by the user. In this fashion, a single pole of the battery 24 may be selectively placed in communication with one of the plurality of conducting pads 38 as desired by the user.

Each light source 28 mounted to the plate 26 has at least one terminal that extends through the plate 26 to be electrically bonded with a conductive pad 38 formed on a top surface 27 of the plate 26. At least one other terminal of each light source 28 is electrically bonded to the conductive surface 54 of the plate 26.

Figure 3:
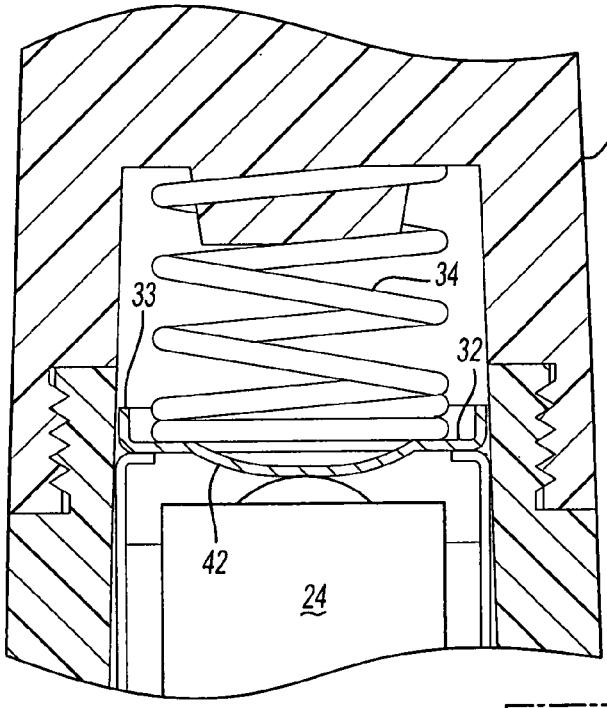
FIG. 3 is a detailed view of certain electrical contacts made between various conducting elements of the self-illuminating writing implement.
Figure 4:
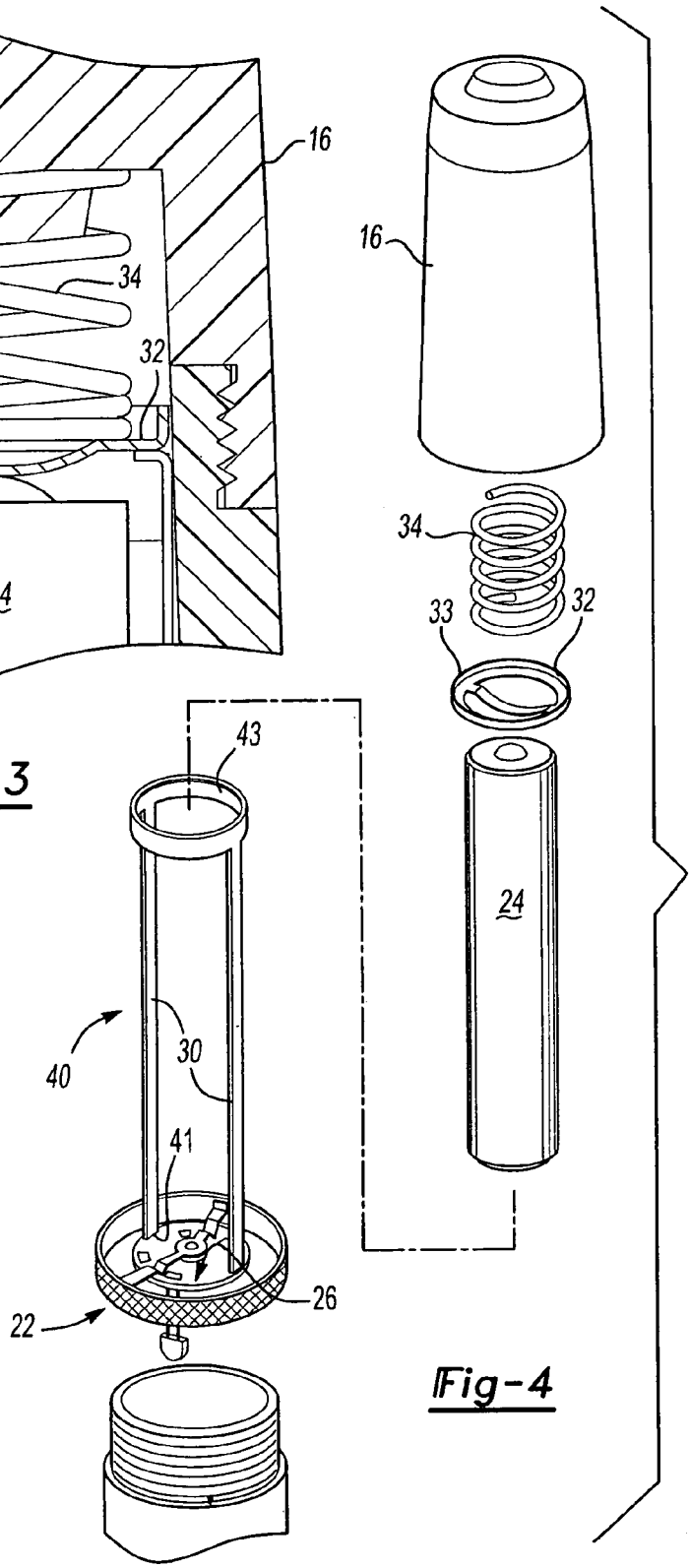
FIG. 4 illustrates an exploded view of the illuminating portion of the self-illuminating writing implement as according to the invention.

Referring now to FIGS. 3–5, a conductive standoff 40 is illustrated having a bottom end 41, a top end 43 and a plurality of elongated conducting portions 30 extending therebetween. The bottom ends 41 of the elongated conductive portions 30 of the conductive standoff 40 are electrically bonded to the conductive surface 54 of the plate 26 through conductive vias, being best illustrated in FIG. 5.

The top end 43 of the conductive standoff 40 forms a ring that is dimensioned to have an inner diameter greater than an outer diameter of the battery 24 such that the battery can be received therethrough in slip fit engagement.

As illustrated in FIGS. 3 and 4, a conductive ring 32 and a spring 34 are provided to cooperate with the conductive standoff 40 to provide a conductive path for current flow from one pole of the battery 24, with the top end 16, spring 34 and conductive ring 32 being removed from the illuminating portion 12 of the self-illuminating writing implement 10, a battery 24 is placed within the conductive standoff 40 such that one pole engages the conducting element 36 of the selector ring assembly 22 and the other pole of the battery 24 is adjacent the top end 43 of the conductive standoff 40. It is appreciated that a plurality of batteries may be used in a series configuration for such purpose.

The conductive ring 32 is then placed in electrical communication with the top end 43 of the conductive standoff 40 such that a curvilinear conductive portion 42 that extends the diameter of the conductive ring 32 engages the pole of the battery 24 adjacent the top end 43. The curvilinear diameter is convexly shaped toward the pole of the battery adjacent the top end 43 of the conductive standoff 40 to ensure the electrical contact is affected. The curvilinear diameter portion 42 is preferably elastically resilient such that it may absorb those pressures associated with fastening the top end 16 of the self-illuminating writing implement 10 to the illuminating portion 12.

The conductive ring 32 includes a rim 33 that extends in a direction opposite the curvilinear diameter 42 of the conductive ring 32. The rim 33 of the conductive ring 32 operates to form a seat for the spring 34 as best illustrated in FIG. 3. After seating the spring 34 on the conductive ring 32, the top end 16 of the illuminating portion 12 is then fastened onto the illuminating portion 12. In this fashion the top end 16 of the illuminating portion 12 causes pressure on the spring 34, which in turn causes pressure on the conductive ring 32 such that it effectively engages the pole of the battery 24 adjacent the top end 43 of the conductive standoff 40.

To initiate current flow through a light source 28, the user begins by placing the conductive element 36 of the selector ring assembly 22 in communication with one of the conductive pads 38 of the plate 26. Current from the battery 24 then flows through the conductive element 36 to the conductive pad 38 and through the light source 28 to the conductive surface 54 of the plate 26. Current then flows through the elongated portions 30 of the conductive standoff 40 to its top end 43 and through the conductive ring 32 to the pole of the battery 24 adjacent the top end 43 completing the circuit.

It may become apparent to those skilled in the art that other structural elements may be used to conduct the flow of current without exceeding the scope of the invention. The preferred embodiment described herein is merely exemplary and is not intended to act as a limitation on the concept of the self-illuminating writing implement 10 described herein.

FIG. 7 illustrates an exploded view of how the selector ring assembly 22 cooperates with the illuminating portion 12 and the marking portion 14 once assembled. Preferably, the selector ring assembly 22 attaches to the illuminating portion 12 such that the conductive element 36 is aligned with complementary recesses 80 formed in the fastening rim 83 of the illuminating portion 12. The complementary fastening rim 85 of the marking portion 14 is formed to be attachable to the fastening rim 83 of the illuminating portion 12 such that the actuating portion 23 of the selector ring assembly 22 is concentrically supported about the complementary fastening rims 83 and 85 after engagement.

The fastening rim 83 of the illuminating portion 12 and the complementary fastening rim 85 of the marking portion 14 include complementary alignment points 84 and 87 to ensure that proper mating or assembly of the illuminating portion 12 and the marking portion 14 is effected. It is appreciated that the complementary fastening rims and alignment elements of the illuminating portion 12 and the marking portion 14 illustrated in FIG. 7 are merely exemplary and are not intended to act as a limitation on the scope of the invention.

Referring again to FIG. 2, the marking portion 14 of the self-illuminating writing implement 10 is shown to include a marker 70 for marking on a marking surface. The working end of the marker 71 extends beyond the marking end 18 of the self-illuminating writing implement 10 through a bore defined by the wall of the marking portion 14 while a top end 72 of the marker 70 is securely seated within a support cylinder 62 adjacent the fastening rim 85 of the marking portion 14 (see FIG. 5 for more detail). The support cylinder 62 is retained adjacent the fastening rim 85 of the marking portion 14 by a plurality of radial arms 86 that extend to the interior wall of the marking portion 14. In this fashion, the marker 70 is retained in alignment with the central axis that extends the length of the self-illuminating writing implement 10.

To replace the marker 70, the user may simply remove the detachable translucent portion 20 of the marking portion 14, firmly grip the tip of the marker to pull it out from the support cylinder 62, and reverse the process to install a new marker. Alternatively, the entire marking portion 14 may simply be replaced with a new marking portion if desired. In this fashion the illuminating portion 12 and the marking portion 14 can be interchanged as desired with different illuminating and marking portions as needed or desired.

In the preferred embodiment the marking portion 14 is comprised of a particular color marker 70. However, the markers are provided in various colors to suit the preference of the user. Thus, the user may select several different colors of markers for use with a plurality of different color light sources extending from the illuminating portion 12 into the marking portion 14 for the projection of light of various colors through the translucent portion 20. Accordingly, a user may choose a red light source for illumination and a black marker for marking on a marking surface or other combinations. Illustratively, a plurality of different color markers may include black, blue, red, green, orange, purple or other colors suitable for marking on a marking surface.

The self-illuminating writing implement 10 may be provided with a marking portion 14 that includes a reflective 75 coating disposed on its interior wall 74 to enhance the propagation of illumination from the light sources 28 through the translucent portion 20 and onto a writing surface. Alternatively, the marking portion 14 of the housing may be entirely translucent or transparent such that entire marking portion 14 illuminates rather than just adjacent the marking end 18.

In the preferred embodiment the light sources 28 used for illumination are solid-state devices 28' such as light emitting diodes 29, laser diodes 31, solid-state lasers 33 or similar devices. Alternatively, nonsolid-state illumination sources may be used without exceeding the scope of the invention as may become apparent to those skilled in the art.

The self-illuminating writing implement 10 of the present invention may also include other features such as a retracting mechanism for retracting the marker 70 within the marking portion 14 or a marking end cap to cover the tip of the marker when not in use. Further, the marking portion 14 of the self-illuminating writing implement may include translucent stenciled portions along its length whereby illumination may be emitted therethrough to simulate a display surface for a manufacturer's logo, a person's name or other words or phrases as desired. An alternative embodiment of the present invention may include an automatic de-multiplexing switch that automatically selects at least one light source for illumination either randomly or sequentially. This alternative embodiment may also feature a latching mechanism that allows the user to manually latch the self-illuminating writing implement on a particular color thus stopping the automatic random or sequential selection process.

From the foregoing it can be seen that the present invention provides a self-illuminating writing implement that includes a plurality of different light sources wherein a single light source is made selectable through the use of a de-multiplexing switch. Having described the invention, however, many modifications thereto may become apparent to those skilled in the art to which it pertains without deviation from the spirit of the invention as defined by the scope of the appended claims.

The invention claimed is:

1. A self-illuminating writing implement comprising:
- a housing having an illuminating portion and a marking portion, the marking portion having a wall defining a bore and a translucent portion adjacent to a marking end;
- a marker mounted within said housing adjacent said marking end;
- a battery mounted within said housing;
- a plurality of light sources of differing colors secured to the illuminating portion of said housing and extending within the marking portion, each of said plurality of light sources operative to emit light through the marking portion when placed in electrical communication with said battery; and
- a de-multiplexing switch in electrical communication with said battery, said de-multiplexing switch rotating to selectably place a single one of said plurality of light sources in electrical communication with said battery such that light from said single one light source of said plurality of light sources is projected only out of said translucent portion adjacent to said marking end.

2. The writing implement of claim 1 wherein said wall has an interior reflective coating.

3. The writing implement of claim 1 wherein said plurality of light sources are solid-state devices.

4. The writing implement of claim 3 wherein said solid-state devices are light emitting diodes.

5. The writing implement of claim 3 wherein said solid-state devices are laser diodes.

6. The writing implement of claim 1 wherein said plurality of light sources are mounted on said de-multiplexing switch.

7. The writing implement of claim 1 wherein the illuminating portion is interchangeable between at least two marking portions wherein the at least two marking portions contain a different color marker.

8. A self-illuminating writing implement comprising:

a housing having an illuminating portion and a marking portion, the marking portion having an interior wall and a translucent portion adjacent a marking end;

a marker mounted within said marking portion adjacent said marking end;

a battery mounted within said housing;

a plurality of light emitting diodes mounted within said housing, each of said plurality of light emitting diodes operative to emit light of a different color only through said translucent portion when placed in electrical communication with said battery;

a reflective coating disposed on a portion of said interior wall of said marking portion; and a de-multiplexing switch in electrical communication with said battery, said de-multiplexing switch rotating to selectably place a single one of said plurality of light emitting diodes in electrical communication with said battery.

* * * * *